US006186071B1

(12) United States Patent
Fry

(10) Patent No.: US 6,186,071 B1
(45) **Date of Patent: *Feb. 13, 2001**

(54) PROJECTILE WITH NON-DISCARDING SABOT

(75) Inventor: Grant R. Fry, Highland, UT (US)

(73) Assignee: Laser II, LLC, Highland, UT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/059,876

(22) Filed: Apr. 14, 1998

(51) Int. Cl.[7] ..... F42B 12/06
(52) U.S. Cl. ..... 102/515; 102/518; 102/522
(58) Field of Search ..... 102/439, 501, 102/507–510, 514–519, 520–523, 529, 503, 506; 29/1.23

(56) References Cited

U.S. PATENT DOCUMENTS

| | | | | |
|---|---|---|---|---|
| 932,014 | * | 8/1909 | Haase | 102/519 |
| 2,382,152 | * | 8/1945 | Jakobsson | 102/523 |
| 3,148,472 | * | 9/1964 | Hegge et al. | 102/521 |
| 3,164,092 | * | 1/1965 | Reed et al. | 102/522 |
| 3,935,816 | * | 2/1976 | Boquette, Jr. | 102/515 |
| 4,653,404 | * | 3/1987 | Halverson | 102/520 |
| 5,038,684 | * | 8/1991 | Petrovich | 102/515 |
| 5,175,392 | * | 12/1992 | Denis | 102/516 |
| 5,183,963 | * | 2/1993 | Beaufils et al. | 102/515 |
| 5,239,928 | * | 8/1993 | Ricci | 102/439 |

FOREIGN PATENT DOCUMENTS

| | | | | |
|---|---|---|---|---|
| 308593 | * | 12/1919 | (DE) | 102/516 |
| 2431676 | * | 3/1980 | (FR) | 102/515 |
| 18589 | * | 1/1910 | (GB) | 102/514 |

* cited by examiner

*Primary Examiner*—Harold J. Tudor
(74) *Attorney, Agent, or Firm*—Kirton & McConkie; Michael F. Krieger

(57) ABSTRACT

A projectile includes a core having a substantially conical head extending from a tip to an outwardly projecting annular lip. A substantially cylindrical body projects from the conical head adjacent to the annular lip and extends to a substantially flat tail end face. An annular slot is bounded between the annular lip and the cylindrical body. An annular groove encircles the body between the conical head and the tail end face. A plastic sabot has a front end with a chamber recessed therein. The chamber is bounded by an inner side surface having a substantially dome shaped annular bulge radially inwardly projecting therefrom. The body of the core is received within the chamber of the sabot such that the front end of the sabot is received within the annular slot on the core and the bulge on the sabot is received within the groove on the core. In another embodiment, a plurality of spaced apart fins inwardly project from the inner side surface of the sabot. The fins are oriented parallel with the longitudinal axis of the sabot. A plurality of spaced apart flutes are longitudinally recessed within the body of the core. The flutes are complementary to the fins and are positioned such that the fins are received within the corresponding flutes when the body of the core is received within the chamber of the sabot.

11 Claims, 5 Drawing Sheets

PROJECTILE WITH NON-DISCARDING SABOT

BACKGROUND OF THE INVENTION

1. The Field of the Invention

The present invention relates to projectiles and, more specifically, projectiles including a non-discarding sabot for discharge from a rifled barrel.

2. Present State of the Art

Guns, such as hand guns and rifles, are designed to interact with a cartridge for discharging a projectile, commonly referred to as a bullet. A cartridge includes a metal case which houses a charge such as gun powder. Mounted at one end of the case is a primer. The projectile is crimped or otherwise secured to the opposing end of the case.

During operation, the cartridge is positioned within the chamber of a gun. By depressing a trigger, a hammer strikes against the primer. In turn, the primer ignites the gun powder which burns at an extremely fast and almost instantaneous rate. As the gunpowder burns, it produces a gas. The rapid expansion of the gas detaches the projectile from the case and pushes the projectile down and out the end of the barrel.

It has long been known that imparting an axial rotation to the projectile significantly improves the accuracy in which the projectile can be fired. Several approaches have been used to impart rotation to the projectile. The most common approach is to form a series of spiral grooves that longitudinally extend along the interior surface of the barrel. The projectile is configured to engage the grooves and thus rotate as the projectile travels the length of the barrel. Momentum allows the projectile to continue to spin after the projectile leaves the barrel.

Depending on the type of projectile used, different approaches have been used to engage the projectile and the grooves. For example, some projectiles are made from relatively soft lead alloys. During discharge, the force of the expanding gas causes the projectile to obterate and radially expand, thereby engaging the grooves. Where the projectile is made of a harder material, the projectile is configured having a diameter slightly larger than the inner diameter of the barrel. As a result, the projectile is forced into the grooves as the projectile travels within the barrel.

Although the operation of guns has become a refined science, there are still several shortcomings associated with conventional projectiles. For example, extended firing of a gun, such as commonly encountered in the military, results in pressure from the expanding gases wearing or deteriorating the interior surface of the gun barrel. Significant wear on the barrel occurs much earlier when hard projectiles are used. The resulting wear on the barrel can produce irregular flight paths in the projectile and can reduce the speed and distance which the projectile travels. In such cases, it is necessary to replace the gun or at least the barrel thereof.

The problem with using lead alloy bullets is that they produce lead build-up on the interior surface of the barrel. Lead build-up increases the resistance on the projectile and can radically increase pressures as well as offset the flight path of the projectile. One approach to solving this problem has been to use various cleaning materials to remove the lead build-up from the interior surface of the barrel. This cleaning process, however, requires the use of toxic solvents that produce a harmful lead waste.

Discarding sabots have been used as another approach to overcoming some of the above problems. A discarding sabot is simply a plastic jacket that is placed over the projectile.

During firing, the expanding gas results in expansion of the projectile and sabot such that the sabot, rather than the projectile, engages the grooves of the barrel. By engaging the grooves, the sabot rotates which in turn imparts a rotational movement to the projectile. As the projectile exits the barrel, the sabot is caught by the surrounding air and peeled off of the projectile, allowing the projectile to freely travel. The discarding sabot thus eliminates and prevents the need for the metal projectile to engage the interior surface of the barrel. As a result, wear on the barrel is minimized. Furthermore, there is no metal fouling or buildup in the barrel.

Although sabots produce some advantages, conventional discarding sabots also produce significant problems. For example, as a discarding sabot leaves the barrel, it rapidly expands to release the projectile. In some instances, the sabot breaks apart resulting in a fouled bore. The discarding sabot can produce bore fouling. Specifically, the discarding sabot can clog or otherwise obstruct such systems as sound suppressors, flash suppressors, gas recoil systems, recoil reduction systems, and bore evacuators. Furthermore, if the sabot does not evenly release the projectile, the projectile can become imbalanced and subsequently tumble.

OBJECTS AND BRIEF SUMMARY OF THE INVENTION

Accordingly, it is an object of the present invention to provide improved projectiles for firing from the barrel of a gun.

Another object of the present invention is to provide improved projectiles as above which minimize wear of the bore.

Yet another object of the present invention is to provide improved projectiles which maximize the effective rotation of the projectile as it is discharged from the barrel of the gun.

Another object of the present invention is to provide projectiles which do not result in bore fouling.

Still another object of the present invention is to provide increased velocity while reducing pressure within the barrel.

Finally, it is an object of the present invention to provide improved projectiles which maximize accuracy.

To achieve the foregoing objects, and in accordance with the invention as embodied and broadly described herein, a projectile is provided for firing from the barrel of a gun. The projectile comprises a core having an exterior surface extending from a conical tip end to an opposing substantially cylindrical tail end. The projectile also includes a plastic sabot having a front end with a chamber recessed therein. The chamber is bounded by an inner side surface and is configured to receive the tail end of the core.

In one embodiment of the invention, longitudinal interlock means are provided for mechanically locking the tail end of the core within the chamber of the sabot such that the sabot remains attached to the core when the core and sabot are discharged from the barrel of the gun. By way of example, the conical tip end of the core terminates at a annular outside lip. An annular slot is bounded between the lip and the exterior surface of the core. An enlarged annular groove encircles the core adjacent to the annular slot. A substantially dome shaped annular bulge radially inwardly projects from the inner side surface of the sabot chamber. The annular bulge is complementary to the enlarged groove on the core. During assembly, the tail end of the core is pressure fit within the chamber of sabot such that the leading edge of the sabot is received within the annular slot on the core and the annular bulge of the sabot is received within the annular groove on the core. This interlocking of the complementary features between the core and sabot prevents radial expansion at the front end of the sabot and longitudinal sliding of the sabot relative to the core. As a result of this engagement, the sabot remains attached to the core when the core and sabot are discharged from the barrel of the gun.

The sabot is configured to engage the barrel of the gun so that the sabot rotates about a longitudinal axis as the sabot is discharged from the barrel of the gun. In one embodiment of the present invention, rotational interlock means are provided for mechanically locking the tail end of the core within the chamber of the sabot such that the core rotates concurrently with the sabot as the sabot and core are discharged from the barrel of the gun. By way of example, a plurality of spaced apart fins inwardly project from the inner side surface of the sabot. The fins are oriented parallel to the longitudinal axis of the sabot. A plurality of spaced apart flutes are longitudinally recessed within the tail end of the core. The flutes are complementary to the fins and are positioned such that the fins are received within the corresponding flutes when the tail end of the core is received within the chamber of the sabot. The interlocking of the flutes and fins requires the core to rotate concurrently with the sabot as the sabot and core are discharged from the barrel of the gun.

The inventive projectile with nondiscarding sabot has significant advantages over prior art projectiles. Like conventional discarding sabots, the nondiscarding sabot also functions to engage the grooves on the interior surface of the barrel. Since only the sabot engages the barrel, soft lead or extremely hard armor piercing metals can be used as the core without wearing or producing buildup on the interior surface of the barrel. Unlike conventional discarding sabots, however, the nondiscarding sabot remains attached to the core. As a result, there is no chance for the sabot to foul or otherwise obstruct the various systems which can be attached to the barrel of a gun. Likewise, there is no concern with the sabot being unevenly removed from the core which can imbalance the stability of the projectile.

Another significant advantage of the inventive projectile is that it can be more easily custom designed for a desired purpose. For example, historically when it was desired to produce a projectile for penetrating armor, it was necessary to use a hardened projectile that could easily penetrate the armor but would quickly wear the barrel. Alternatively, a softer projectile could be used that would not so rapidly wear the barrel. However, for the softer projectile to penetrate the armor, an increased charge needed to be used to increase the speed at which the projectile traveled. Increasing the charge, however, increases the danger in using the gun and also significantly increases the kick or recoil produced by the gun. By using the present invention, a core can be selected of a desired material to achieve a desired end. This can be accomplished without increasing wear on the barrel, the amount of charge used, or the resulting recoil.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
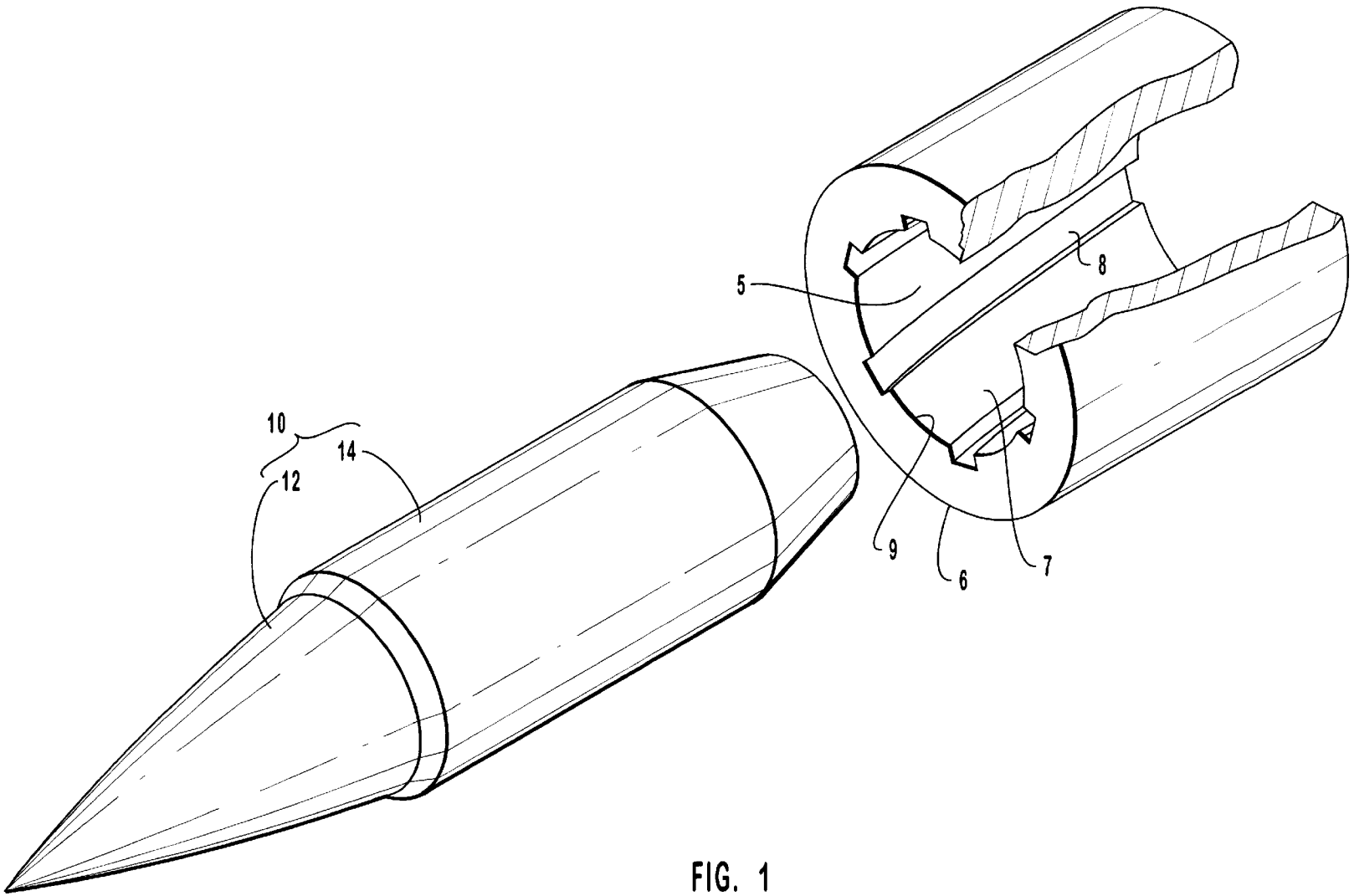
FIG. 1 is a perspective view of an inventive projectile having a core and a no-discarding plastic sabot being discharged from the barrel of a gun.

Depicted in FIG. 1 is one embodiment of a projectile 10 incorporating features of the present invention. Projectile 10 comprises a core 12 attached to a non-discarding sabot 14. Although not depicted, projectile 10 is configured for attachment to the case of a conventional cartridge and can be selectively discharged from a barrel 6 of a gun, such as a rifle or hand gun. Barrel 6 has in interior surface 7 bounding a bore 5. A plurality of spiral grooves 8 are recessed on interior surface 7 and extend the length of barrel 6. Extending between each of grooves 8 are lands 9.

Figure 2:
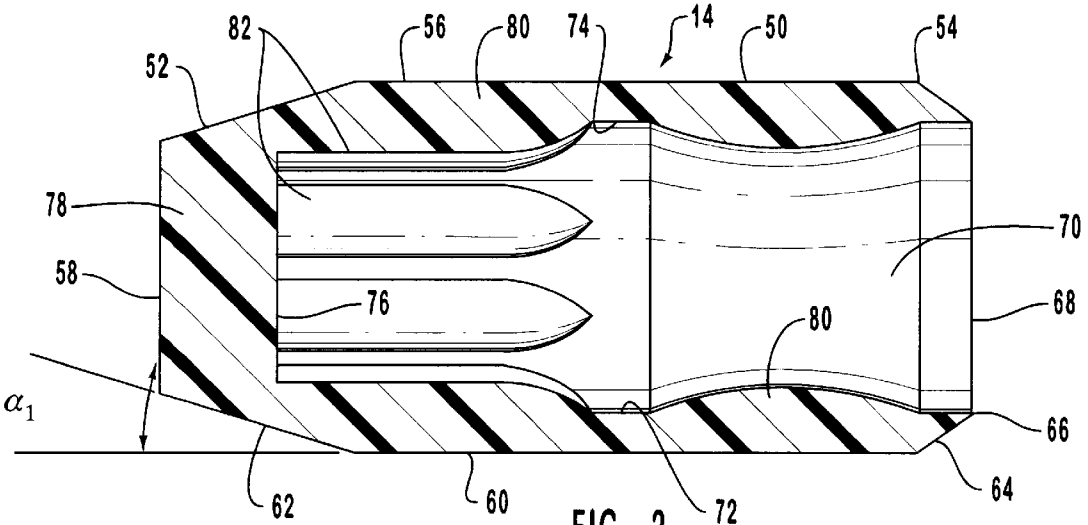
FIG. 2 is a cross-sectional side view of the sabot shown in FIG. 1.

Depicted in FIG. 2, sabot 14 has an exterior surface 50 extending from a base end 52 to a front end 54. Exterior surface 50 includes an outer side surface 56 that extends along the length of sabot 14 and a substantially flat, circular end face 58 positioned at base end 52. Outer side surface 56 further includes a substantially cylindrical portion 60, an annular tapered rear portion 62 extending from cylindrical portion 60 to end face 58, and an annular front tapered portion 64 extending from cylindrical portion 60 to a circular leading edge 66. Rear portion 62 is tapered at an angle $\alpha_1$ relative to cylindrical portion 60 in a range between about 16° to about 19° with about 17° being more preferred.

Leading edge 66 bounds an opening 68 to a chamber 70 recessed within sabot 14. Chamber 70 is bounded by an interior surface 72. Interior surface 72 includes a substantially cylindrical inner side surface 74 extending along the length of chamber 70 and a substantially flat floor 76. Extending between floor 76 and end face 58 is a base 78. Projecting from base 78 between inner side surface 74 and outer side surface 56 is tubular sidewall 81.

Figure 3:
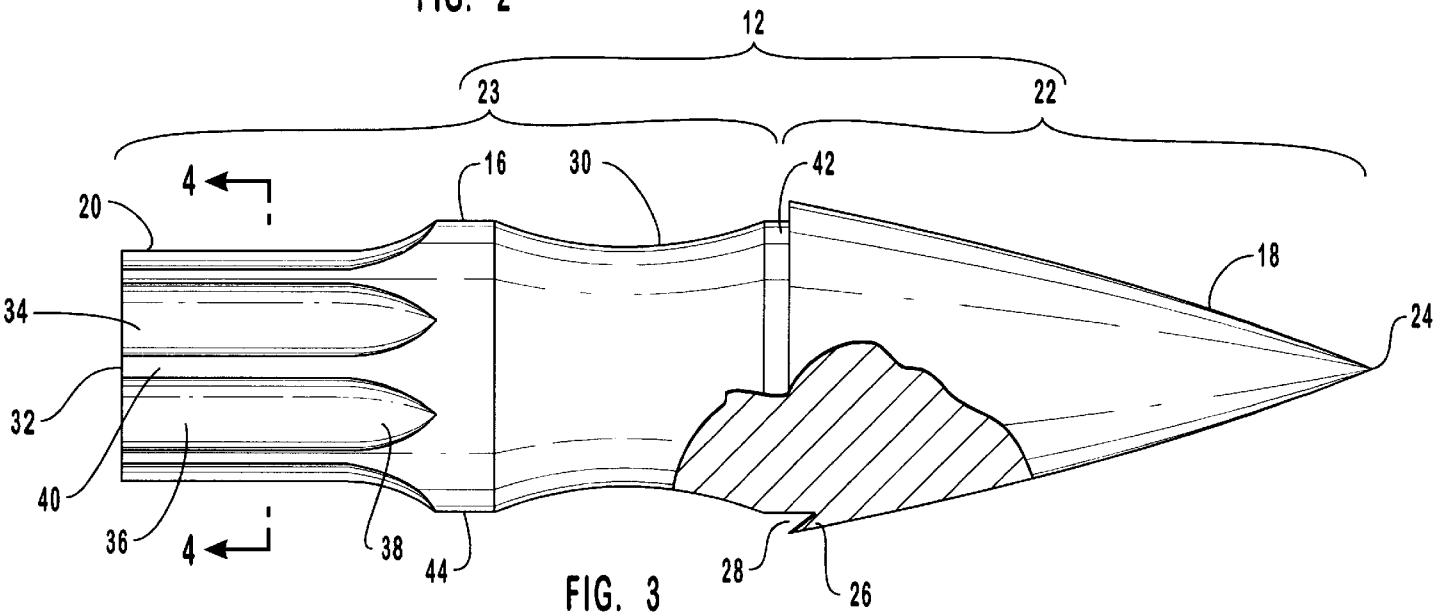
FIG. 3 is a partially cutaway side view of the core shown in FIG. 1.

Depicted in FIG. 3, core 12 has an exterior surface 16 extending from a tip end 18 to an opposing tail end 20. Core 12 comprises a conical head 22 positioned at tip end 18 and a substantially cylindrical body 23 positioned at tail end 20. Conical head 22 radially outwardly extends from a tip 24 to an outwardly projecting annular lip 26. Lip 26 projects back towards tail end 20 so that an annular slot 28 is formed between lip 26 and cylindrical body 23. Body 23 extends from conical head 22 to a substantially flat tail face 32.

Body 23 of core 12 is configured to be received within chamber 70 of sabot 14. In one embodiment, longitudinal interlock means are provided for mechanically locking core 12 within chamber 70 of sabot 14 such that sabot 14 remains attached to core 12 when core 12 and sabot 14 are discharged from barrel 6 of a gun. By way of example and not by limitation, a substantially dome shaped annular bulge 80 radially inwardly projects from inner side surface 74 of sabot 14 as depicted in FIG. 2. Likewise, as depicted in FIG. 3, an annular groove 30 encircles body 23 and is recessed therein. Groove 30 is bounded on opposing sides by a cylindrical front ledge 42 and a cylindrical back ledge 44. Groove 30 is complementary to bulge 80 and is positioned such that bulge 80 is received within groove 30 when body 23 of core 12 is received within chamber 70 of sabot 14.

Figure 5:
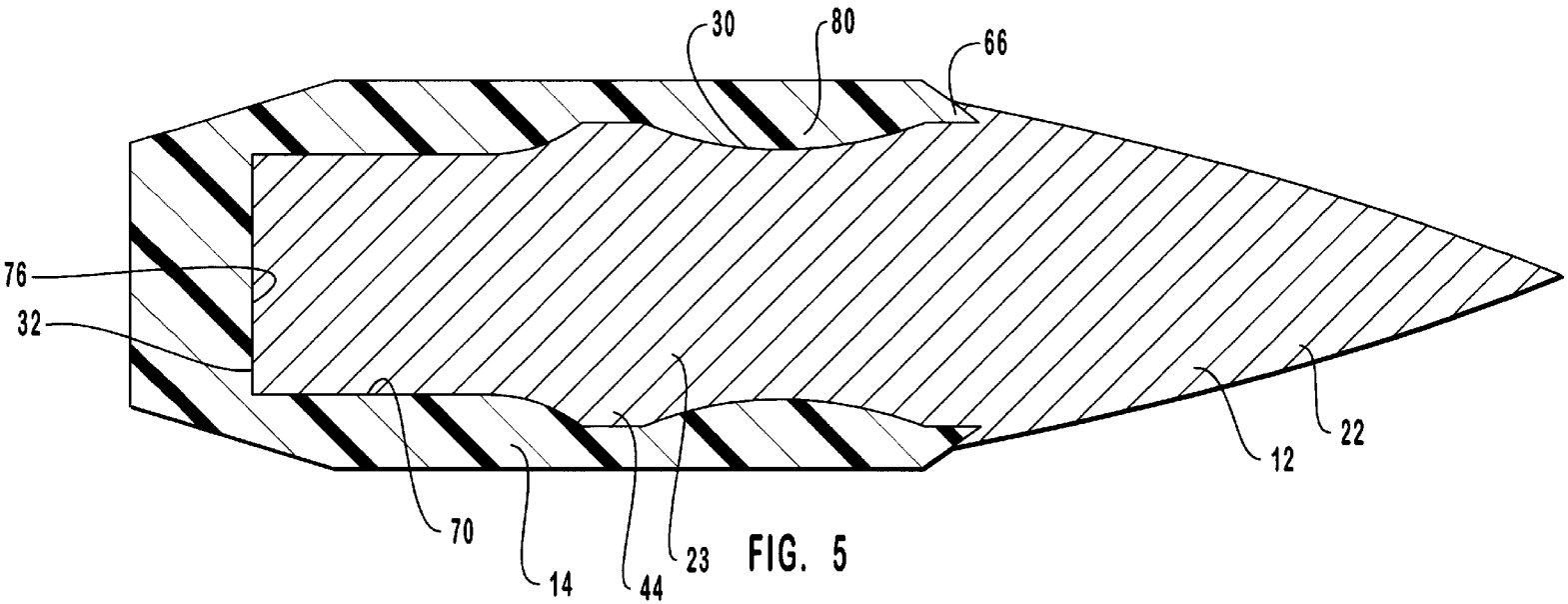
FIG. 5 is a cross-sectional side view of the projectile shown in FIG. 1.

Body 23 of core 12 is complementary to chamber 70 of sabot 14 with a matching tolerance between +/−0.001 inches. During assembly, a conventional press is used to pressure fit body 23 within chamber 70 as depicted in FIG. 5. In the assembled condition, tail face 32 of core 12 is fitted against floor 76 of sabot 14; bulge 80 is received within groove 30; and leading edge 66 of sabot 14 is received within slot 28 of core 12. Because of the close tolerance, little or no air or space exists between core 12 and sabot 14.

As the combined sabot 14 and core 12 are discharged from barrel 6 of a gun, air friction and other forces attempt to strip sabot 14 off of core 12. Leading edge 66 of sabot 14, however, is prevented from radial expansion as a result of being captured within slot 28 of core 12. Simultaneously, sabot 14 is prevented from sliding back on core 12 as a result of bulge 80 being received within groove 30. Specifically, bulge 80 biases against back ledge 44 to prevent backward sliding. As a result of the combined interlocking features which prevent radial expansion of sabot 14 and backward sliding of sabot 14, sabot 14 remains attached to core 12 when combined core 12 and sabot 14 are discharged from barrel 6.

In alternative embodiments for the longitudinal interlock means, the present invention also envisions that groove 30 on core 12 and bulge 80 on sabot 14 can be reversed.

Sabot 14 can be made out of a variety of different plastics or composites thereof. In one embodiment, sabot 14 is made of polycarbonate combined with a softer plastic such as polyester or polypropylene. Examples of acceptable materials include Zenoy®, Nylon 6®, and Nylon 66® each available from DuPont. Although a variety of different materials can be used, in the preferred embodiment the material is sufficiently soft to enable core 12 to be pressure fit into sabot 14 without cracking or failure of sabot 14. The material, however, must also be sufficiently rigid so that sabot 14 is not deformed and pulled off of core 12 during discharge. To minimize friction resistance between sabot 14 and barrel 6, it is also desirable that sabot 14 be made of a material having a low friction factor.

Sabot 14 can be made using a variety of different process methods. For example, sabot 14 can be injection molded using a mold core that is subsequently removed from sabot 14. Alternatively, sabot 14 can be directly injection molded onto core 12, thereby eliminating the pressure fitting step. In one injection molding process, the mold base is comprised of a split base-plate mold. In yet other embodiments, sabot 14 can be made using a dipping process or a flow around process.

One of the functions of sabot 14 is to engage grooves 8 formed on interior surface 7 of barrel 6. As a result of sabot 14 engaging grooves 8, sabot 14, and thus or spins around the longitudinal axis of projectile 10. To engage sabot 14 with barrel 6, sabot 14 is nominally oversized such that sabot 14 is larger in diameter than bore 5. In the firing process, sabot 14 is swedged to fit the diameter of bore 5. High lubricity of sabot 14 materials allows minimal friction within bore 5. Sabot 14 expands into grooves 8, thereby facilitating the desired engagement for rotation. Expansion of sabot 14 also helps to capture the gas behind projectile 10 within barrel 6. As a result, the force of the gas on projectile 10 is maximized.

In alternative embodiments, core 12 can be made of harder materials such as stainless steel, uranium, or titanium. In these embodiments, sabot 14 needs to again have an outer diameter that is slightly larger than the inner diameter of lands 9 of grooves 8. Accordingly, as projectile 10 travels within bore 5, sabot 14 engages within grooves 8, thereby imparting the desired rotation. Since only sabot 14 and not core 12 engages barrel 6, core 12 can be made out of any material that can withstand the force of the discharge. For example, core 12 can be made out of metals, plastics, or composites.

Since core 12 is typically made of a denser material than sabot 14, core 12 resists rotating currently with sabot 14. Accordingly, the present invention also includes rotational interlock means for mechanically locking core 12 within chamber 70 of sabot 14 such that core 12 rotates concurrently with sabot 14 as the combined sabot 14 and core 12 are discharged from barrel 6. By way of example and not by limitation, depicted in FIG. 2 are a plurality of spaced apart fins 82 inwardly projecting from inner side surface 74 of sabot 14. Fins 82 are oriented parallel with the longitudinal axis of sabot 14 and extend from floor 76.

The rotational interlock means further includes a plurality of spaced apart flutes 34 longitudinally recess within tail end 20 of core 12. Flutes 34 have a configuration complementary to fins 82 and are positioned such that fins 82 are received within corresponding flutes 34 when core 12 is received within chamber 70 of sabot 14.

Each of flutes 34 has a linear section 36 that begins at tail face 32 and ends at an upwardly curved, spade shaped terminus 38. Each of flutes 34 are separated by spaced apart linear ribs 40. As depicted in both FIGS. 3 and 4, each linear section 36 maintains a substantially constant transverse cross-sectional configuration.

During assembly, core 12 is pressure fit into chamber 70, as previously discussed, so that fins 82 are snugly received within corresponding flutes 36. The engagement between fins 82 and flutes 36 prevents core 12 from rotationally slipping within chamber 70 of sabot 14. As a result, core 12 rotates concurrently with sabot 14. To ensure that core 12 does not slip within sabot 14, flutes 36 need to be sufficiently deep that the corresponding fin 82 is securely held therein. Flutes 36, however, should not be too deep or a sharp edge will form at the transition between flutes 36 and ribs 40. A sharp edge at this point can result in cutting and thus failure of sabot 14.

In alternative embodiments for the rotational interlock means, the present invention also envisions that flutes 34 on core 12 and fins 82 on sabot 14 can be reversed.

To improve the accuracy in which projectile 10 travels, it is desirable that the discharge force be uniformly applied to projectile 10. If the force is unevenly applied to projectile 10 within barrel 6, projectile 10 will rebound after it leaves barrel 6. As a result, projectile 10 can become unbalanced and subsequently begin to tumble. Since pressure within barrel 6 is lower within grooves 8 than on lands 7, it is preferred that when an even number of grooves 8 are present, projectile 10 has an odd number of flutes 34 and corresponding fins 82. Likewise, if an odd number of grooves 8 are present, it is preferred, although not necessary, that an even number of flutes 34 and corresponding fins 82 be used.

For example, in 0.223 caliber guns which typically have four grooves 8, it is preferred to a have five flutes 34. Likewise, in 0.30 and 0.50 caliber guns which typically have six grooves 8, it is preferred to a have seven flutes 34.

Figure 4:
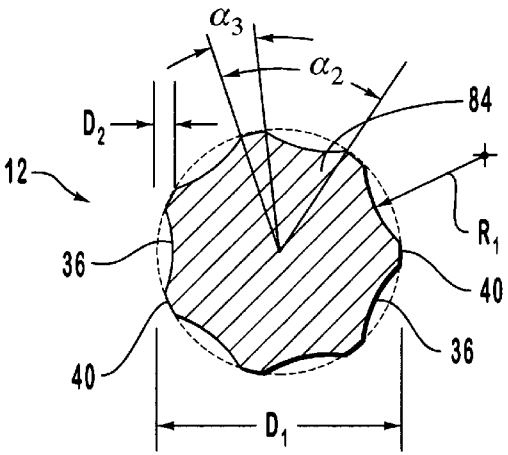
FIG. 4 is a cross-sectional end view of the core shown in FIG. 3 taken along section lines 4—4.

By way of example and not by limitation, in one embodiment of projectile 10 used with a 0.50 caliber gun, as depicted in FIG. 4, core 12 is divided into seven equal pie shaped sections 84 each have a flute 36 and a rib 40. Each of sections 84 has an angle $\alpha_2$ of 51.43°. Within each section 84, rib 40 covers an angle a 3 in a range between about 12° to about 14°. Each flute has an inside radius R of 0.110 inches. Body 23 of core 12 has a maximum outer diameter $D_1$ of about 0.333 inches and a flute depth $D_2$ of about 0.007 inches.

Figure 6:
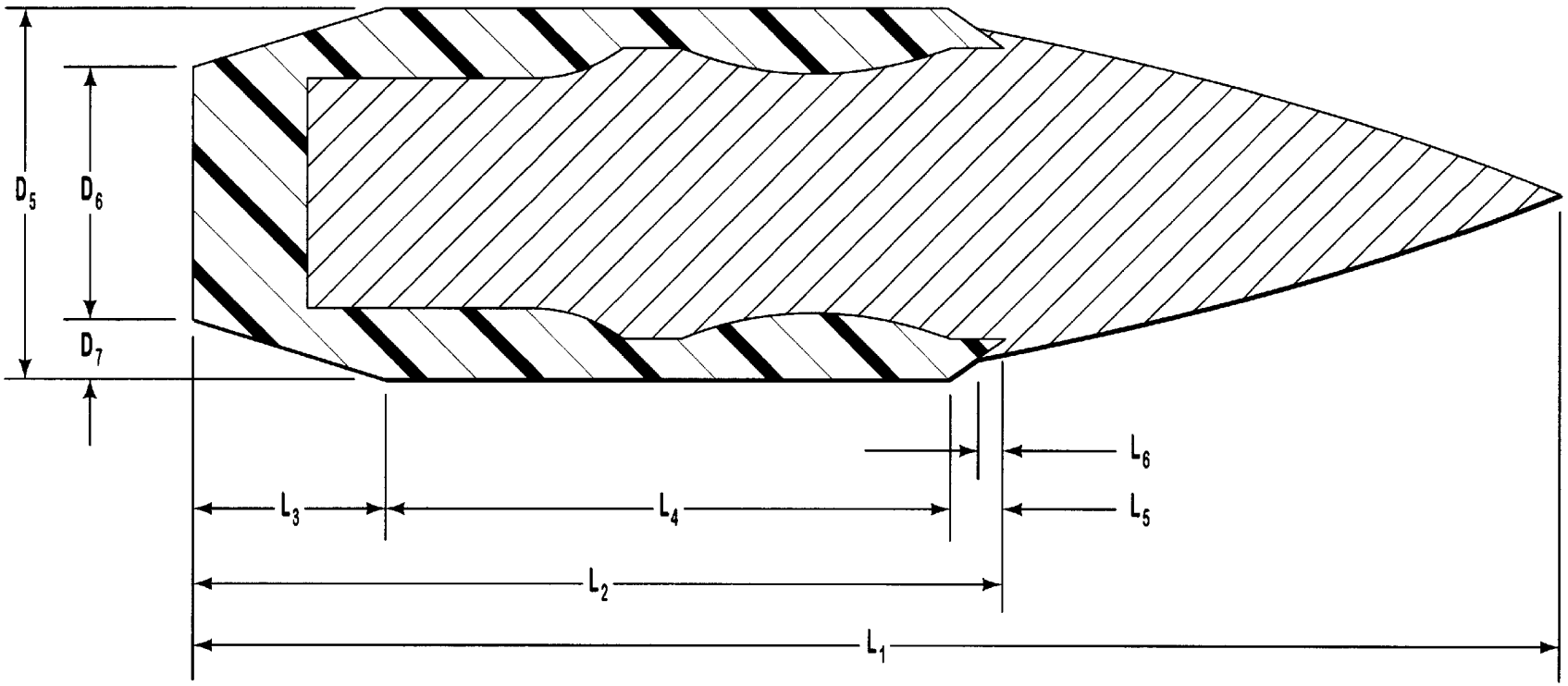
FIG. 6 is the view of FIG. 5 with dimension references thereon.
Figure 7:
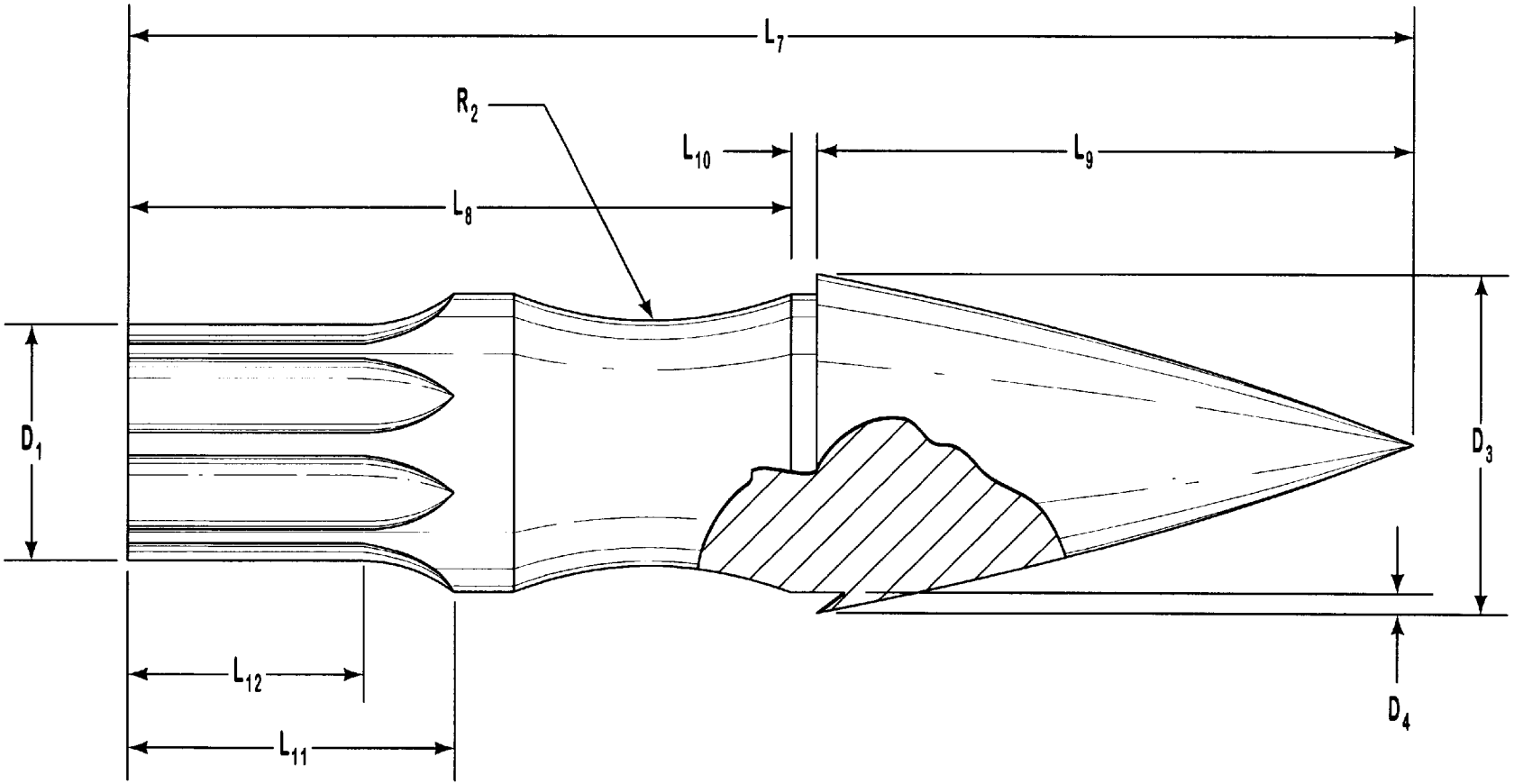
FIG. 7 is the view of FIG. 3 with dimension references thereon.

Other relevant dimension for manufacturing one embodiment of projectile 10 for use with a 0.50 caliber gun are set forth below in Table 1. The reference letters in Table 1 correspond to the dimension depicted in FIGS. 4, 6, and 7.

TABLE 1

| | |
|---|---|
| $L_1$ = 2.750 inches | $D_1$ = 0.333 inches |
| $L_2$ = 1.933 inches | $D_2$ = 0.007 inches |
| $L_3$ = 0.394 inches | $D_3$ = 0.495 inches |
| $L_4$ = 1.355 inches | $D_4$ = 0.081 inches |
| $L_5$ = 0.184 inches | $D_5$ = 0.513 inches |
| $L_6$ = 0.081 inches | $D_6$ = 0.257 inches |
| $L_7$ = 2.550 inches | $D_7$ = 0.128 inches |
| $L_8$ = 1.571 inches | $R_1$ = 0.110 inches |
| $L_9$ = 0.898 inches | $R_2$ = 0.400 inches |
| $L_{10}$ = 0.081 inches | |
| $L_{11}$ = 0.700 inches | |
| $L_{12}$ = 0.500 inches | |

The overall projectile length $L_1$ varies for projectiles 10 used with different caliber guns. For example, in one embodiment $L_1$ is 1.30 inches for use with a 0.30 caliber gun and 0.80 inches for use with a 0.223 caliber gun. The remaining dimensions as set forth in Table 1 vary proportionally with the change in length $L_1$.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A projectile for firing from a gun barrel, comprising:

a core having a rearward facing annular slot located on an exterior of said core;

a plastic sabot partially surrounding said core and having a leading edge complementary to said slot, said leading edge being configured to lock into said slot so that said sabot and said core will remain attached during firing and flight of said projectile;

means for biasing said leading edge end into said slot so that said leading edge exerts a positive pressure against said slot.

2. The projectile of claim 1 wherein said means for biasing is a concave groove in said core and a complementary bulge in said sabot positioned such that assembly of said core with said sabot biases said leading edge into said slot.

3. The projectile of claim 1 wherein said core further comprises a plurality of longitudinal flutes and said sabot further comprises a plurality of fins complementary to said flutes and the number of fins on said sabot are an even number when the number of grooves in the barrel of a gun in which the projectile is to be fired is an odd number and the number of flutes in said core and the number of fins on said sabot are an odd number when the number of grooves in the barrel of the gun in which the projectile is to be fired is an even number.

4. A projectile for firing from a gun barrel, comprising:

a core having a tip end and an opposing tail end, said tip end forming a substantially conical shape which increases in diameter toward said tail end to a maximum diameter defining an annular lip, said tip end thereafter decreasing in diameter toward a front of said projectile thereby forming a rearward facing annular slot circumscribed by said annular lip and bounded on the interior by a cylindrical ledge, said core further comprising a concave annular groove and longitudinal flutes formed therein and said tail end having a smaller cross-sectional area than said annular lip;

a plastic sabot having a chamber formed therein for receiving said tail end of said core, said chamber having an inner side surface shaped with a convex annular bulge complementary to said concave annular groove in said core and said chamber also being shaped with longitudinal protruding fins complementary to said longitudinal flutes in said core, and said sabot further comprising a front end shaped complementary to said annular slot, said annular groove and said annular bulge being positioned and shaped so as to bias said front end against said annular slot when said core is assembled with said sabot so that said core and said sabot will remain attached throughout the trajectory of the projectile.

5. The projectile of claim 4 wherein the number of flutes in said core and the number of complementary fins on said sabot are an even number when the number of grooves in the barrel of a gun in which the projectile is to be fired is an odd number and the number of flutes in said core and the number of complementary fins on said sabot are an odd number when the number of grooves in the barrel of the gun in which the projectile is to be fired is an even number.

6. The projectile of claim 4 wherein the number of flutes in said core and the number of complementary fins on said sabot equal 5 when the number of grooves in the barrel of the gun in which the projectile is to be fired is 4.

7. The projectile of claim 4 wherein the number of flutes in said core and the number of complementary fins on said sabot equal 7 when the number of grooves in the barrel of the gun in which the projectile is to be fired is 6.

8. The projectile of claim 4 wherein the number of flutes in said core and the number of complementary fins on said sabot equal 7 when the caliber of the gun in which the projectile is to be fired is 0.50.

9. A projectile for firing from a gun barrel, comprising:

a core comprising an exposed tip, a rearward facing annular slot configured to retain a leading edge of a plastic sabot and prevent said leading edge from disengaging from said slot during firing and throughout the trajectory of the projectile, and a body for receiving a sabot;

a plastic sabot configured to contact the interior surface of a gun barrel and be exposed to direct aerodynamic forces during flight of the projectile and configured to surround said body and having a leading edge configured to engage said slot, said leading edge being shaped complementary to said slot; and a structure for biasing said leading edge into said slot so that said leading edge is forced against said slot exerting pressure thereon thereby preventing said leading edge from detaching from said slot during firing and throughout the trajectory of said projectile.

10. The projectile of claim 9 wherein said structure for biasing is a concave groove in said core and a complementary bulge in said sabot positioned such that assembly of said core with said sabot biases said leading edge into said slot.

11. A projectile specifically designed for use with a gun having a fixed number of grooves in the gun barrel, said projectile comprising:

a core comprising an exposed tip, a rearward facing annular slot configured to retain a leading edge of a plastic sabot and prevent said leading edge from disengaging from said slot during firing and throughout the trajectory of the projectile, and a body for receiving a sabot;

a plastic sabot configured to surround said body and to contact the interior surface of a gun barrel and to be exposed to direct aerodynamic forces during flight of the projectile, said sabot having a leading edge configured to engage said slot in said core, said leading edge being shaped complementary to said slot;

a structure for biasing said leading edge into said slot so that said leading edge is forced against said slot exerting pressure thereon thereby preventing said leading edge from detaching from said slot during firing and throughout the trajectory of said projectile; and a quantity of flutes on said body and an equal quantity of complementary fins on said sabot, said quantity being an even number when the number of grooves in the gun barrel is an odd number and said quantity being an odd number when the number of grooves in the gun barrel is an even number.

* * * * *